US011788547B2

(12) United States Patent
Teramoto et al.

(10) Patent No.: US 11,788,547 B2
(45) Date of Patent: Oct. 17, 2023

(54) PROPELLER FAN, AIR-SENDING DEVICE, AND REFRIGERATION CYCLE DEVICE

(71) Applicant: Mitsubishi Electric Corporation, Tokyo (JP)

(72) Inventors: Takuya Teramoto, Tokyo (JP); Takahide Tadokoro, Tokyo (JP); Katsuyuki Yamamoto, Tokyo (JP); Hiroya Ito, Tokyo (JP); Yuki Ugajin, Tokyo (JP); Shingo Hamada, Tokyo (JP); Takashi Ikeda, Tokyo (JP); Takafumi Abe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/852,740

(22) Filed: Jun. 29, 2022

(65) Prior Publication Data

US 2022/0325721 A1 Oct. 13, 2022

Related U.S. Application Data

(63) Continuation of application No. 16/619,692, filed as application No. PCT/JP2017/028959 on Aug. 9, 2017, now Pat. No. 11,434,924.

(51) Int. Cl.

| | |
|---|---|
| ***F04D 29/38*** | (2006.01) |
| ***F04D 25/02*** | (2006.01) |
| ***F04D 29/053*** | (2006.01) |

(52) U.S. Cl.

CPC ..... *F04D 29/38* (2013.01); *F04D 25/02* (2013.01); *F04D 29/053* (2013.01); (Continued)

(58) Field of Classification Search

CPC ..... F04D 29/38; F04D 29/386; F04D 29/384; F04D 29/388; F04D 29/646; F04D 29/681; F05D 2240/306

See application file for complete search history.

(56) References Cited

U.S. PATENT DOCUMENTS

| | | | |
|---|---|---|---|
| 4,854,374 | A | 8/1989 | Harrison |
| 6,126,395 | A | 10/2000 | Shingai |

(Continued)

FOREIGN PATENT DOCUMENTS

| | | | |
|---|---|---|---|
| CN | 2751167 | Y | 1/2006 |
| CN | 201650862 | U | 11/2010 |

(Continued)

OTHER PUBLICATIONS

International Search Report of the International Searching Authority dated Oct. 31, 2017 for the corresponding International application No. PCT/JP2017/028959 (and English translation).

(Continued)

*Primary Examiner* — Eldon T Brockman
*Assistant Examiner* — Andrew J Marien
(74) *Attorney, Agent, or Firm* — POSZ LAW GROUP, PLC

(57) ABSTRACT

A propeller fan includes a shaft portion disposed on a rotation axis, and a blade disposed on an outer peripheral side of the shaft portion and including a leading edge and a trailing edge. The blade includes a negative pressure surface in which a plurality of recesses are formed, and the plurality of recesses include a first recess and a second recess disposed on the trailing edge side than the first recess in a circumferential direction about the rotation axis as a center. The first recess has a depth larger than a depth of the second recess.

5 Claims, 8 Drawing Sheets

(52) U.S. Cl.
CPC ..... *F04D 29/384* (2013.01); *F04D 29/386* (2013.01); *F04D 29/388* (2013.01)

(56) References Cited

U.S. PATENT DOCUMENTS

| | | | |
|---|---|---|---|
| 6,395,025 | B1 | 5/2002 | Fordenbacher et al. |
| 2004/0187691 | A1 | 9/2004 | Lee |
| 2014/0341748 | A1 | 11/2014 | Kojima et al. |
| 2016/0177968 | A1 | 6/2016 | Gebert et al. |
| 2018/0030996 | A1 | 2/2018 | Schilling et al. |
| 2018/0080468 | A1 | 3/2018 | Kim et al. |
| 2018/0087784 | A1 | 3/2018 | Sawada |
| 2018/0306034 | A1 | 10/2018 | Teramoto |
| 2020/0018323 | A1 | 1/2020 | Cao et al. |

FOREIGN PATENT DOCUMENTS

| | | | |
|---|---|---|---|
| JP | S55-83591 | U | 6/1980 |
| JP | H03-294699 | A | 12/1991 |
| JP | H05-215098 | A | 8/1993 |
| JP | H07-259795 | A | 10/1995 |
| JP | H10-246200 | A | 9/1998 |
| JP | 2012-220171 | A | 11/2012 |
| JP | 2013-104310 | A | 5/2013 |
| JP | 3188542 | U | 1/2014 |
| JP | 2014-206054 | A | 10/2014 |
| JP | 2015-194147 | A | 11/2015 |
| KR | 101474496 | B1 | 12/2014 |
| WO | 2017/ 077575 | A1 | 5/2017 |

OTHER PUBLICATIONS

Office Action dated Jul. 21, 2020 issued in corresponding JP patent application No. 2019-535515 (and English translation).
Office Action dated Jul. 23, 2020 issued in corresponding CN patent application No. 201780093402.2 (and English translation).
Indian Examination Report dated Dec. 29, 2020, issued in corresponding IN Patent Application No. 202047002373.
Japanese Office Action dated Jan. 26, 2021, issued in corresponding JP Patent Application No. 2019-535515 (and English Machine Translation).
Office Action dated May 17, 2021, issued in corresponding CN Patent Application No. 201780093402.02 (and English Machine Translation).
Office Action dated Oct. 15, 2021, issued in corresponding EP Patent Application No. 17 920 625.5.
Examination Report dated Nov. 18, 2021 issued in corresponding AU Patent Application No. 2020289818.
Office Action dated Jun. 14, 2022 issued in corresponding JP Patent Application No. 2021-127960 (with English machine translation).
Office Action dated Dec. 9, 2022 issued in corresponding CN Patent Application No. 202110894179.X (and Machine Translation).
Examination Report dated Oct. 18, 2022 issued in corresponding IN Patent Application No. 202148028357.
Office Action dated Jun. 21, 2023 issued in corresponding Chinese Patent Application No. 202110894179.X (and English machine translation).

PROPELLER FAN, AIR-SENDING DEVICE, AND REFRIGERATION CYCLE DEVICE

CROSS REFERENCE TO RELATED APPLICATION

This application is a continuation of U.S. Utility application Ser. No. 16/619,692 filed on Dec. 5, 2019, which is a U.S. national stage application of PCT/JP2017/028959 filed on Aug. 9, 2017, the contents of which are incorporated herein by reference.

TECHNICAL FIELD

The present invention relates to a propeller fan including a shaft portion and a blade on an outer peripheral side of the shaft portion, an air-sending device, and a refrigeration cycle device.

BACKGROUND ART

Patent Literature 1 describes an impeller of an air-sending device. The impeller of an air-sending device includes a blade having a lower pressure surface in which plural substantially circular dimples are formed. The dimples have a diameter of 1 mm to 20 mm, and a depth of 5% to 50% of the thickness of the blade.

CITATION LIST

Patent Literature

Patent Literature 1: Japanese Unexamined Patent Application Publication No. 3-294699

SUMMARY OF INVENTION

Technical Problem

A blade is typically more susceptible to flow separation at its trailing edge than at the leading edge. Thus, the blade having the recesses may promote flow separation with the recesses at the trailing edge of the blade. The impeller of an air-sending device of Patent Literature 1 thus has a problem that the efficiency of an air-sending device may be degraded.

The present invention has been attained to solve the above problem and aims to provide a propeller fan, an air-sending device, and a refrigeration cycle device that can improve the efficiency.

Solution to Problem

A propeller fan according to an embodiment of the present invention includes a shaft portion disposed on a rotation axis; and a blade disposed on an outer peripheral side of the shaft portion, and including a leading edge and a trailing edge. The blade includes a negative pressure surface in which a plurality of recesses are formed, and the plurality of recesses include a first recess and a second recess disposed on the trailing edge side than the first recess in a circumferential direction about the rotation axis at a center. The first recess has a depth larger than a depth of the second recess.

An air-sending device according to an embodiment of the present invention includes the propeller fan according to any one of the above embodiments of the present invention; an air-sending device motor that drives the propeller fan; and a support element that includes a motor fixing portion to which the fan motor is fixed and a support portion that supports the motor fixing portion. When viewed in a direction parallel to the rotation axis, the plurality of recesses are formed only in an inner peripheral side of a minimum circle that surrounds the motor fixing portion about the rotation axis at a center.

A refrigeration cycle device according to an embodiment of the present invention includes the propeller fan according to any one of the above embodiments of the present invention.

A refrigeration cycle device according to an embodiment of the present invention includes an air-sending device according to any one of the above embodiments of the present invention.

Advantageous Effects of Invention

According to embodiments of the present invention, the recesses disposed at the trailing edge in the circumferential direction are allowed to have a smaller depth, and can thus prevent promotion of flow separation at the trailing edge of the blade. This structure can thus improve the efficiency of a propeller fan.

DESCRIPTION OF EMBODIMENTS

Embodiment 1

Figure 1:
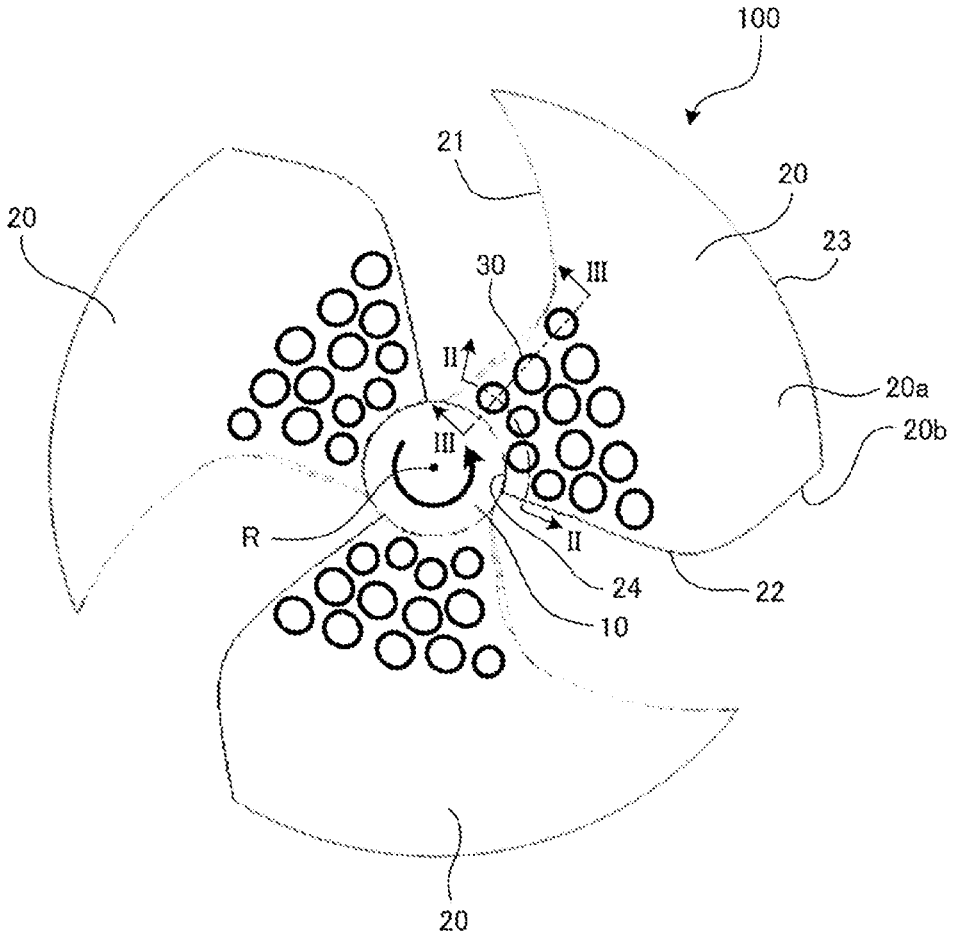
FIG. 1 is a back view of a structure of a propeller fan 100 according to Embodiment 1 of the present invention.

A propeller fan according to Embodiment 1 of the present invention will be described. The propeller fan is installed in a refrigeration cycle device such as an air-conditioning apparatus, or a ventilator. FIG. 1 is a back view of a structure of a propeller fan 100 according to the present embodiment. As illustrated in FIG. 1, the propeller fan 100 includes a hollow cylindrical boss 10 (an example of a shaft portion), which is disposed on a rotation axis R and rotates about the rotation axis R, and plural plate-shaped blades 20, disposed on the outer peripheral side of the boss 10. The plural blades 20 are arranged at regular angular distances about the boss 10 at the center. A rotation direction of the propeller fan 100 is a counterclockwise direction, as indicated by arrow in FIG. 1. In FIG. 1, a surface of each blade 20 on the near side serves as a negative pressure surface 20*a*, and a surface of each blade 20 on the far side serves as a pressure surface 20*b*. The number of blades 20 is not limited to three. The plural blades 20 may be arranged at different angular distances about the boss 10 at the center. The shape of the boss 10 is not limited to a hollow cylindrical shape.

Each blade 20 has a leading edge 21, a trailing edge 22, an outer peripheral edge 23, and an inner peripheral edge 24. The leading edge 21 is an edge portion located on the front side of the blade 20 in the rotation direction. The trailing edge 22 is an edge portion located on the rear side of the blade 20 in the rotation direction. The outer peripheral edge 23 is an edge portion located on the outer peripheral side of the blade 20 to connect the outer peripheral end of the leading edge 21 to the outer peripheral end of the trailing edge 22. The inner peripheral edge 24 is an edge portion located on the inner peripheral side of the blade 20 to connect the inner peripheral end of the leading edge 21 to the inner peripheral end of the trailing edge 22. The inner peripheral edge 24 is connected to the outer peripheral surface of the boss 10. The blade 20 is formed of resin.

Each blade 20 has plural recesses 30 in the negative pressure surface 20*a*. In the present embodiment, the plural recesses 30 are formed only in a portion of the negative pressure surface 20*a* of the blade 20 near the inner periphery. The plural recesses 30 are circular or elliptic when viewed in a direction parallel to the rotation axis R. Here, the recesses 30 may have another shape such as a polygonal shape when viewed in a direction parallel to the rotation axis R.

Figure 2:
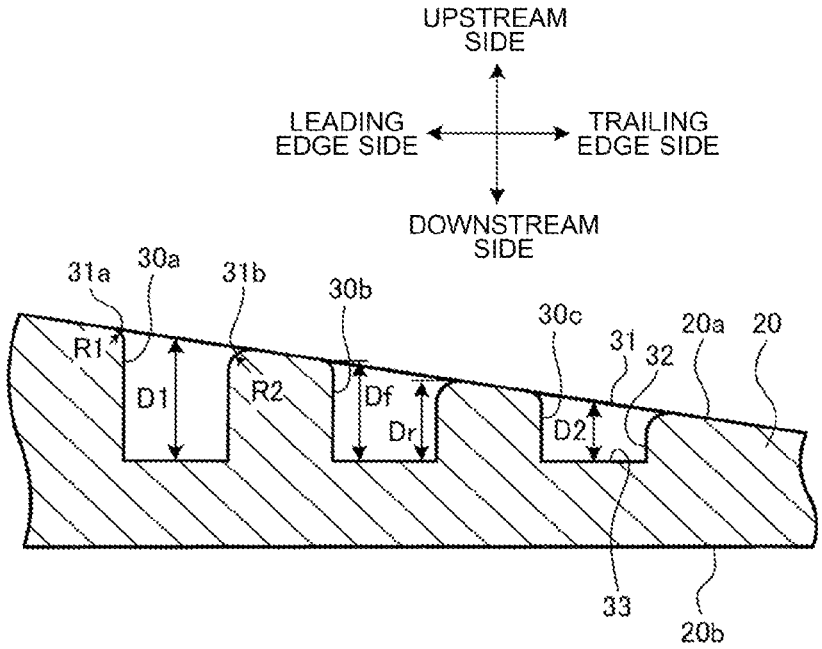
FIG. 2 is a schematic cross-sectional view taken along line II-II of FIG. 1.

FIG. 2 is a schematic cross-sectional view taken along line II-II in FIG. 1. FIG. 2 is a cross-sectional view of the blade 20 in the circumferential direction about the rotation axis R at the center. FIG. 2 illustrates three recesses 30*a*, 30*b*, and 30*c* of the plural recesses 30. The up and down directions in FIG. 2 indicate the direction parallel to the rotation axis R, the upper side represents an upstream side of an airflow, and the lower side represents a downstream side of an airflow. The left and right directions in FIG. 2 indicate the circumferential direction about the rotation axis R at the center, the left side represents the side closer to the leading edge 21, and the right side represents a side closer to the trailing edge 22. Here, the same cylindrical surface about the rotation axis R as the center passes through the recesses 30*a*, 30*b*, and 30*c*, but not necessarily passes the centers of all the recesses 30*a*, 30*b*, and 30*c*. However, FIG. 2 illustrates cross-sectional shapes of the recesses 30*a*, 30*b*, and 30*c* on the assumption that they are taken by a cylindrical surface that passes all the centers.

As illustrated in FIG. 2, each of the recesses 30*a*, 30*b*, and 30*c* has a chamfered opening end 31 formed in the negative pressure surface 20*a*, a cylindrical inner wall surface 32 extending from the opening end 31 in the direction parallel to the rotation axis R, and a substantially flat bottom surface 33. Among the three recesses 30*a*, 30*b*, and 30*c*, through which the same cylindrical surface about the rotation axis R as the center passes, the recess 30*a* (an example of a first recess) is located closest to the leading edge 21 in the circumferential direction about the rotation axis R as the center. In the present embodiment, the recess 30*a* is located closest to the leading edge 21 in the circumferential direction among all the recesses 30 formed in the negative pressure surface 20*a* of one blade 20. The recess 30*b* is located on to the trailing edge 22 side than the recess 30*a* in the circumferential direction. The recess 30*c* (an example of a second recess) is located on the trailing edge 22 side than the recesses 30*a* and 30*b* in the circumferential direction. However, the recesses 30*a*, 30*b*, and 30*c* are not necessarily disposed on the same circumference about the rotation axis R as the center. The blade thickness distribution of the blade 20 shows a larger blade thickness toward the leading edge 21, and a smaller thickness toward the trailing edge 22.

The recess 30*a* has a depth of D1. Here, the depth of the recess 30 refers to a distance in the direction parallel to the rotation axis R from the center portion of the opening end 31 of the recess 30 to the bottom surface 33. A depth D2 of the recess 30*c* located on the trailing edge 22 side than the recess 30*a* is smaller than the depth D1 (D1>D2). In the present embodiment, the recesses 30 on the leading edge 21 side in the circumferential direction have larger depths, and the recesses 30 on the trailing edge 22 side in the circumferential direction have smaller depths.

When the depth of each of the recesses 30*a*, 30*b*, and 30*c* at a portion on the leading edge 21 side than the center portion of the opening end 31 is denoted by Df and the depth of each of the recesses 30*a*, 30*b*, and 30*c* at a portion on the trailing edge 22 side than the center portion of the opening end 31 is denoted by Dr, the depth Df is larger than the depth Dr (Df>Dr).

Each of the recesses 30*a*, 30*b*, and 30*c* has, in the cross section taken in the circumferential direction, a first opening end 31*a* at a portion on the leading edge 21 side and a second opening end 31*b* at a portion on the trailing edge 22 side. A radius of curvature R1 of the first opening end 31*a* is smaller than a radius of curvature R2 of the second opening end 31*b* (0≤R1<R2).

Figure 3:
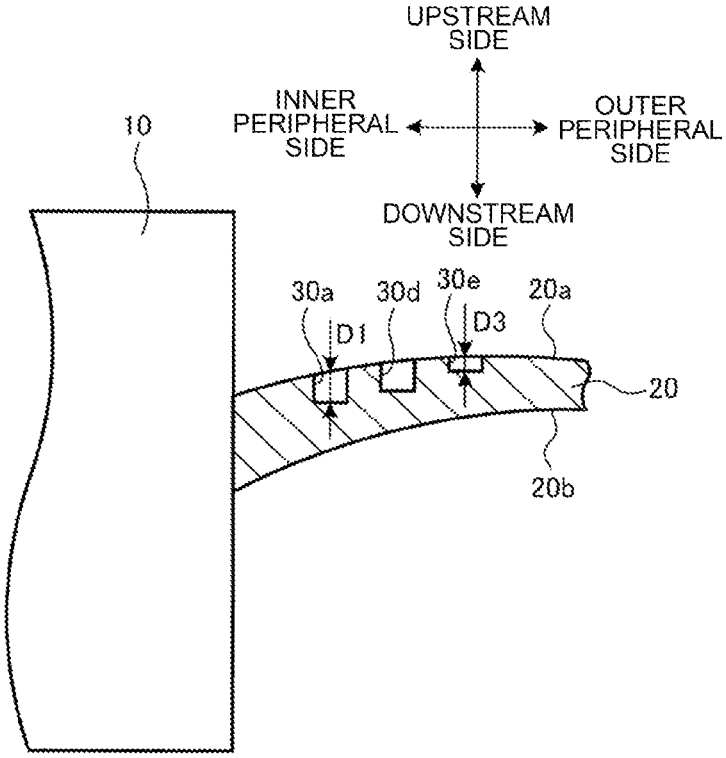
FIG. 3 is a schematic cross-sectional view taken along line III-III of FIG. 1.

FIG. 3 is a schematic cross-sectional view taken along line III-III in FIG. 1. FIG. 3 is a cross section of the blade 20 having the rotation axis R as the center taken in the radial direction. FIG. 3 illustrates three recesses 30*a*, 30*d*, and 30*e* of the plural recesses 30. The up and down directions in FIG. 3 represent the direction parallel to the rotation axis R, the upper side represents the upstream side in an airflow, and the downstream side represents the downstream side in an airflow. The left and right directions in FIG. 3 represent the radial direction from the rotation axis R as the center, the left side represents the inner peripheral side, and the right side represents the outer peripheral side. Here, the same plane including the rotation axis R passes through the recesses 30*a*, 30*d*, and 30*e*, but does not necessarily passes all the centers of the recesses 30*a*, 30*d*, and 30*e*. However, FIG. 3 illustrates cross-sectional shapes of the recesses 30*a*, 30*d*, and 30*e* on the presumption that they are taken by a plane that passes the centers of all the recesses.

As illustrated in FIG. 3, the depth D3 of the recess 30*e* disposed on the outer peripheral side is smaller than the depth D1 of the recess 30*a* located on the inner peripheral side than the recess 30*e* (D3<D1). The depth D3 of the recess 30*e* is smaller than the depth D2 of the recess 30*c* illustrated in FIG. 2. The recess 30*e* functions as a dimple that prevents promotion of flow separation. When viewed in a direction parallel to the rotation axis R, the recess 30*e* on the outer peripheral side may have the shape and size the same as or different from those of the recess 30*a* on the inner peripheral side. The blade thickness distribution of the blade 20 shows a larger blade thickness toward the inner peripheral side, and a smaller thickness toward the outer peripheral side.

As described above, the propeller fan 100 according to the present embodiment includes the boss 10 disposed on the rotation axis R, and the blades 20 disposed on the outer peripheral side of the boss 10 and each including the leading edge 21 and the trailing edge 22. Each blade 20 has, in the negative pressure surface 20*a*, the plural recesses 30 including the recess 30*a* and the recess 30*c* disposed on the trailing edge 22 side than the recess 30*a* in the circumferential direction about the rotation axis R as the center. The depth D1 of the recess 30*a* is larger than the depth D2 of the recess 30*c*. Here, the boss 10 is an example of a shaft portion. The recess 30*a* is an example of a first recess. The recess 30*c* is an example of a second recess.

This structure reduces the depth D2 of the recess 30*c* located on the trailing edge 22 side in the circumferential direction, and thus prevents promotion of flow separation on the side closer to the trailing edge 22 of the blade 20. This structure can thus improve the efficiency of the propeller fan 100. The recesses 30 also serve as relief recesses to reduce the weight of the blade 20 while retaining the strength of the blades 20. Thus, the present embodiment can achieve an air-sending device with low power consumption including the propeller fan 100. Each of the recesses 30 can reduce the thickness between the bottom surface 33 of the recess 30 and the pressure surface 20*b*. This structure prevents generation of sink marks during manufacturing of the blades 20. Thus, the robustness of the blades 20 during a forming step is improved.

In the propeller fan 100 according to the present embodiment, each of the plural recesses 30 has the depth Df on the leading edge 21 side that is larger than the depth Dr on the trailing edge 22 side. This structure hinders air that flows along the negative pressure surface 20*a* from the leading edge 21 toward the trailing edge 22 from entering the recesses 30. This structure also facilitates discharge of part of air that has entered the recesses 30 from the recesses 30 toward the trailing edge 22. This structure can thus reduce air resistance of the blade 20, and improve the efficiency of the propeller fan 100.

In the propeller fan 100 according to the present embodiment, the recess 30*a* is located closest to the leading edge 21 in the circumferential direction among the plural recesses 30. This structure achieves the effect of preventing promotion of flow separation at a part on the trailing edge 22 side of the blade 20 over a wider area of the negative pressure surface 20*a* of the blade 20.

In the propeller fan 100 according to the present embodiment, each of the plural recesses 30 has, in the cross section taken in the circumferential direction, the first opening end 31*a* located on the leading edge 21 side and the second opening end 31*b* located on the trailing edge 22 side. The radius of curvature R1 of the first opening end 31*a* is smaller than the radius of curvature R2 of the second opening end 31*b*. In this structure, part of air flowing along the negative pressure surface 20*a* and entering the recesses 30 is easily discharged from the recesses 30 toward the trailing edge. This structure can thus further improve the efficiency of the propeller fan 100.

Embodiment 2

Figure 4:
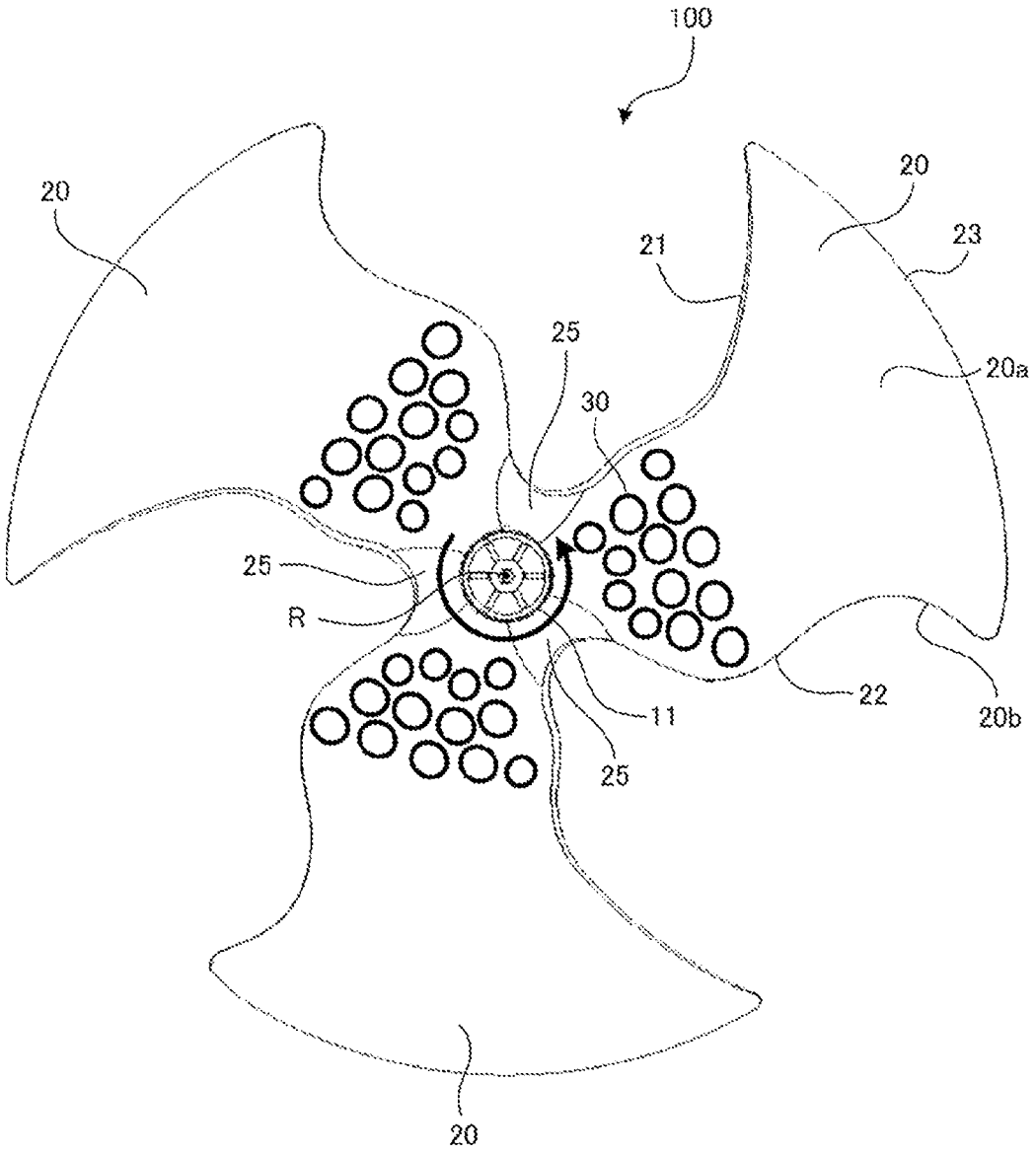
FIG. 4 is a back view of a structure of a propeller fan 100 according to Embodiment 2 of the present invention.

A propeller fan according to Embodiment 2 of the present invention will be described. FIG. 4 is a back view of a structure of a propeller fan 100 according to the present embodiment. The components having the same functions and effects as those of Embodiment 1 will be denoted with the same reference signs, and a description thereof is omitted. As illustrated in FIG. 4, the propeller fan 100 includes a hollow cylindrical shaft portion 11 disposed on the rotation axis R, plural plate-shaped blades 20 disposed on the outer peripheral side of the shaft portion 11, and plural connection portions 25, each of which connects two of the plural blades 20 adjacent to each other in the circumferential direction.

The shaft portion 11 protrudes along the rotation axis R from both the negative pressure surface 20*a* and the pressure surface 20*b*. Each of the connection portions 25 has, for example, a plate shape, and is adjacent to the outer periphery of the shaft portion 11. Each of the plural connection portions 25 smoothly connects, the trailing edge 22 of one of the two blades 20 adjacent to each other in the circumferential direction, located to the front in the rotation direction of the propeller fan 100, and the leading edge 21 of the blade 20 located to the rear in the rotation direction. Each of the plural connection portions 25 smoothly connects the negative pressure surfaces 20*a* of two blades 20 adjacent in the circumferential direction, and smoothly connects the pressure surfaces 20*b* of two blades 20 adjacent in the circumferential direction.

The propeller fan 100 is the so-called boss-less propeller fan not including a boss 10. The shaft portion 11, the plural blades 20, and the plural connection portions 25 are formed of resin in a single unit. Specifically, the shaft portion 11, the plural blades 20, and the plural connection portions 25 form an integrated blade. The propeller fan 100 rotates in a counterclockwise direction as indicated by an arrow in FIG. 4.

Each blade 20 has plural recesses 30 in the negative pressure surface 20*a*. In the present embodiment, the plural recesses 30 are formed only in a portion of the negative pressure surface 20*a* of the blade 20 located on the inner peripheral side. Each connection portion 25 is located on the inner peripheral side than at least one of the plural recesses 30 formed in the corresponding blade 20. Nevertheless, no recesses 30 are formed in an upstream surface (surface on the near side in FIG. 3) of the connection portion 25.

As described so far, the propeller fan 100 according to the present embodiment includes the plural blades 20 disposed on the outer periphery of the shaft portion 11, and the connection portions 25 disposed adjacent to the shaft portion 11 to each connect two of the plural blades 20 adjacent to each other in the circumferential direction. This structure achieves the same advantageous effects as those in Embodiment 1.

In the propeller fan 100 according to the present embodiment, no recesses 30 are formed in the upstream surface of each connection portion 25. The upstream surface of each connection portion 25 is not necessarily a negative pressure surface. Thus, the recesses 30, if formed, may increase the air resistance of the blade 20. The structure of the present embodiment that does not include the recesses 30 in the connection portions 25 can prevent degradation of the efficiency of the propeller fan 100.

Embodiment 3

Figure 5:
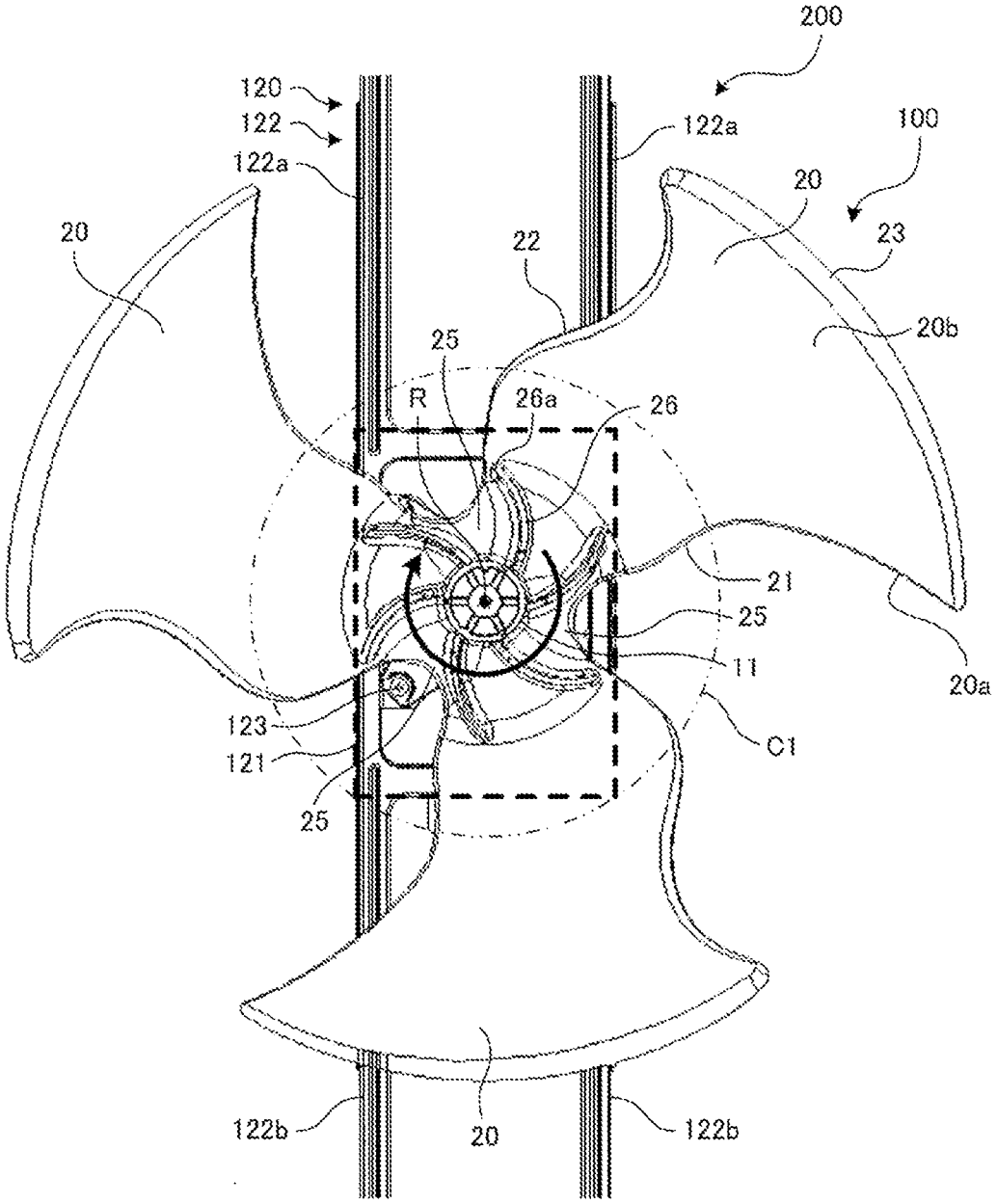
FIG. 5 is a front view of a related portion of an air-sending device 200 according to Embodiment 3 of the present invention.
Figure 6:
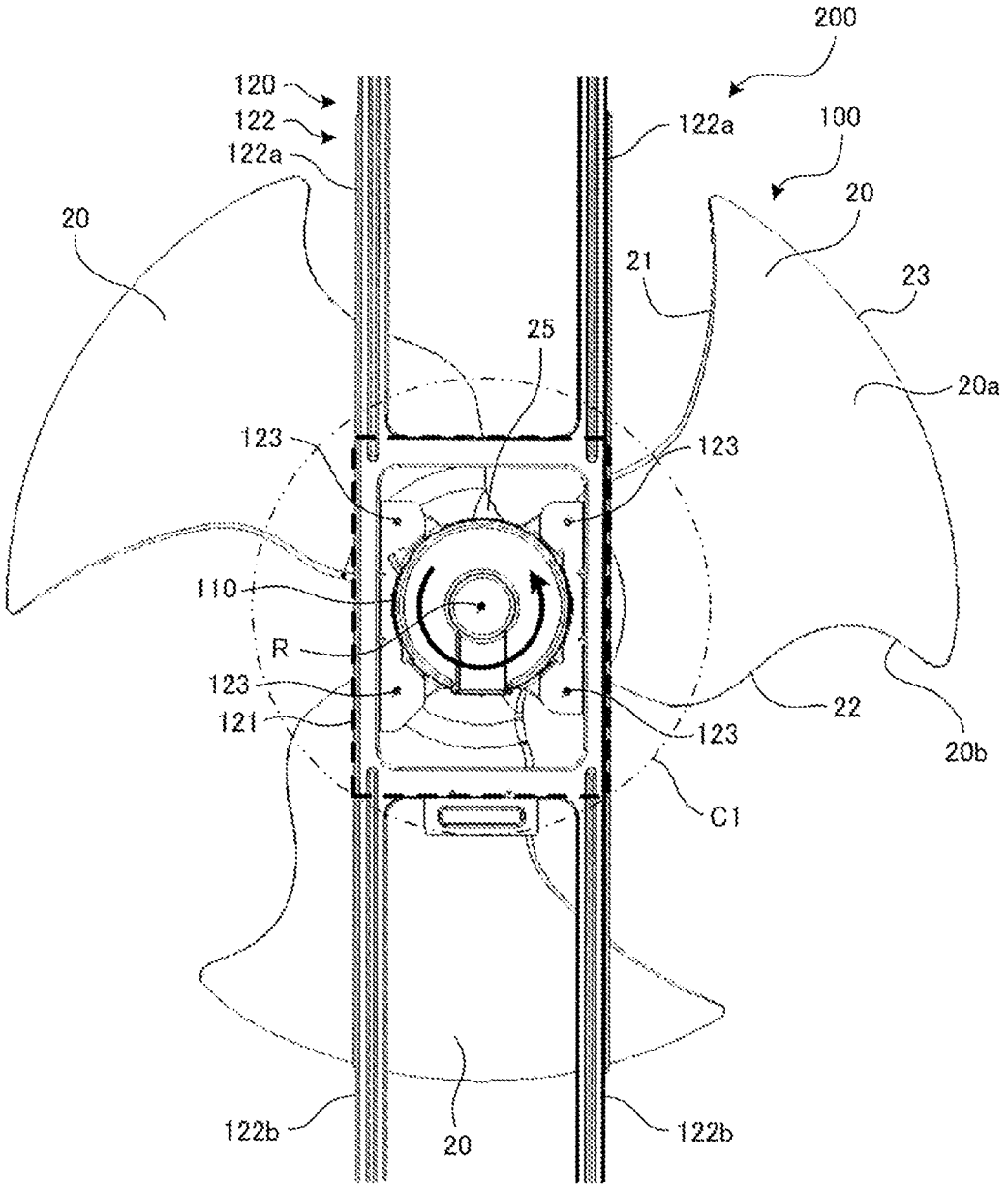
FIG. 6 is a back view of a related portion of the air-sending device 200 according to Embodiment 3 of the present invention.

A propeller fan and a fan according to Embodiment 3 of the present invention will be described. FIG. 5 is a front view of a related structure of an air-sending device 200 according to the present embodiment. FIG. 6 is a back view of a related structure of the air-sending device 200 according to the present embodiment. FIG. 5 illustrates the structure of the air-sending device 200 when viewed from the pressure surface 20*b* of the propeller fan 100. FIG. 6 illustrates the structure of the air-sending device 200 when viewed from the negative pressure surface 20*a* of the propeller fan 100. Up and down directions in FIG. 5 and FIG. 6 represent the vertical direction. FIG. 6 does not illustrate the recesses 30 formed in the negative pressure surfaces 20*a* of the blades 20 of the propeller fan 100. The recesses 30 will be described later with reference to FIG. 7.

As illustrated in FIG. 5 and FIG. 6, the air-sending device 200 includes a propeller fan 100, a fan motor 110, which drives the propeller fan 100, and a support element 120, which supports the fan motor 110. The support element 120 includes a motor fixing portion 121, to which the fan motor 110 is fixed, and a support portion 122, which supports the motor fixing portion 121. The support element 120 is fixed to a housing, not illustrated.

The shaft portion 11 of the propeller fan 100 is connected to the output axis of the fan motor 110 disposed on the rotation axis R. The fan motor 110 is fixed to the motor fixing portion 121 with a fastening element 123, such as a screw.

The motor fixing portion 121 of the support element 120 has a rectangular frame shape extending in the vertical direction. The motor fixing portion 121 may have a plate shape. In FIG. 5 and FIG. 6, the outline of the motor fixing portion 121 is drawn with a thick broken line. When viewed in a direction parallel to the rotation axis R, the outline of the motor fixing portion 121 is disposed on the outer side of the fan motor 110 to surround the fan motor 110 or to overlap part of the fan motor 110. When viewed in a direction parallel to the rotation axis R, the outline of the motor fixing portion 121 is disposed on the inner periphery of a rotation locus of the outer peripheral edges 23 of the blades 20. In FIG. 6, when viewed in a direction parallel to the rotation axis R, a minimum circle C1 that surrounds the entirety of the motor fixing portion 121 about the rotation axis R as the center is drawn with a two-dot chain line. The circle C1 is located on the inner peripheral side of the rotation locus of the outer peripheral edges 23 of the blades 20. When viewed in the direction parallel to the rotation axis R, the motor fixing portion 121 is disposed to overlap an area of the propeller fan 100 that undergoes aerodynamic work to a lesser extent. Specifically, the area of the propeller fan 100 on the inner peripheral side of the circle C1 is an area that undergoes aerodynamic work to a lesser extent.

The support portion 122 of the support element 120 includes two upper support portions 122*a*, extending upward from the motor fixing portion 121 in parallel, and two lower support portions 122*b*, extending downward from the motor fixing portion 121 in parallel. The upper support portions 122*a* and the lower support portions 122*b* are substantially arranged on the extension lines of the long sides of the motor fixing portion 121.

In the propeller fan 100, plural ribs 26, which protrude in the direction along the rotation axis R, are formed on the pressure surface 20*b* of each blade 20 and the downstream surface of each connection portion 25. Each of the plural ribs 26 extends radially outward from the outer peripheral portion of the shaft portion 11. Each of the plural ribs 26 has a turbo blade shape curved to protrude forward in the rotation direction. The plural ribs 26 have a function of structurally reinforcing the shaft portion 11 of the propeller fan 100, the plural blades 20, and the plural connection portions 25. The number of ribs 26 in the present embodiment is six, which is two times of the number of blades 20. Specifically, two ribs 26 are provided for each blade 20. At least one of the ribs 26 extends across each connection portion 25 and the corresponding blade 20. A radially outward end portion 26*a* of each of the plural ribs 26 is located on the inner peripheral side of the circle C1. Specifically, the plural ribs 26 are located on the inner peripheral side of the circle C1.

Figure 7:
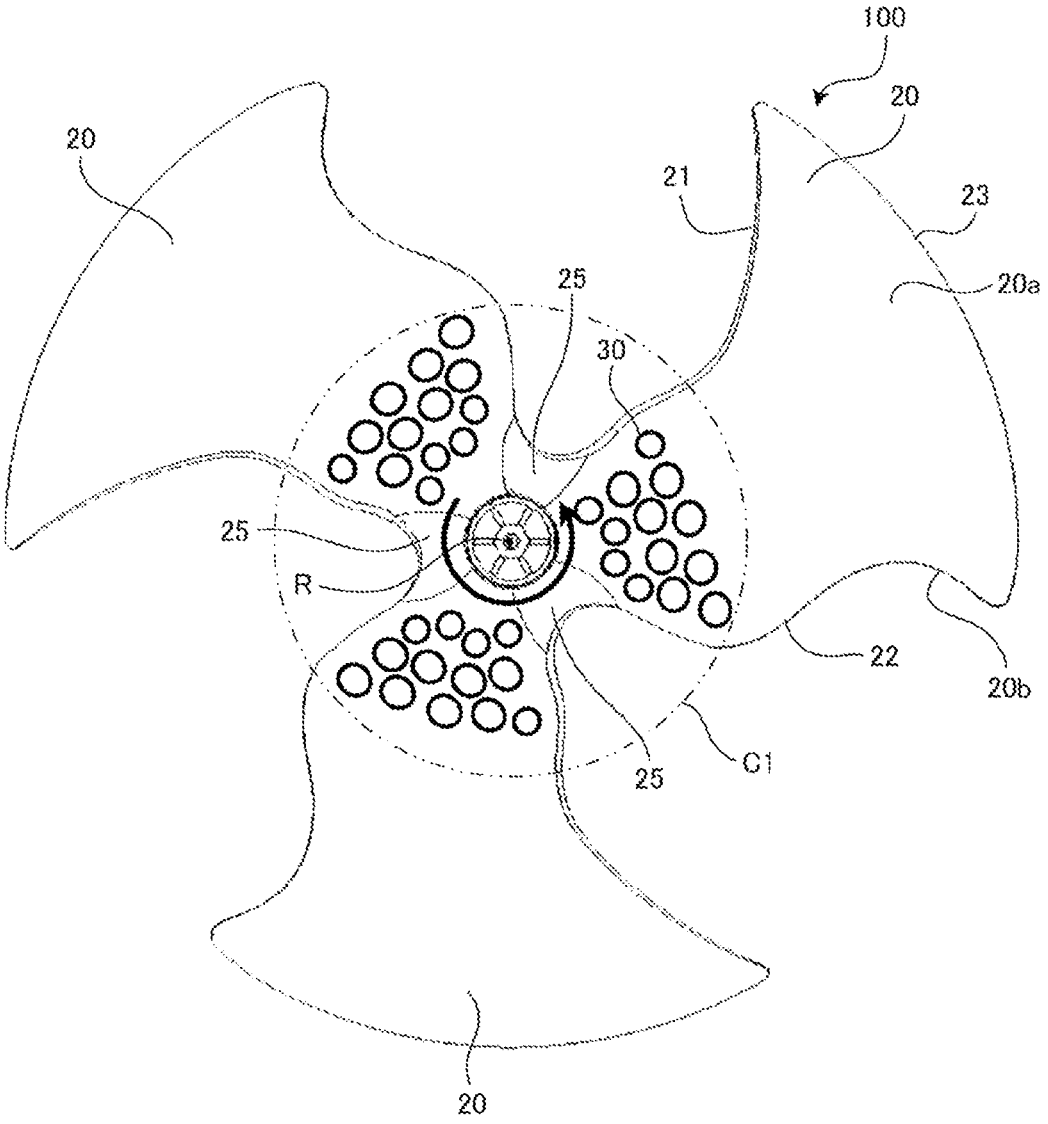
FIG. 7 is a back view of a structure of a propeller fan 100 according to Embodiment 3 of the present invention.

FIG. 7 is a back view of the structure of the propeller fan 100 according to the present embodiment. As illustrated in FIG. 7, the plural recesses 30 are formed in an area of the negative pressure surface 20*a* of each blade 20 on the inner peripheral side of the circle C1. The blade surface shape of the negative pressure surface 20*a* in the area on the inner peripheral side of the circle C1 negligibly affects the aerodynamic characteristics of the propeller fan 100. Thus, the plural recesses 30 have depths determined regarding the function as relief recesses as important. Each connection portion 25 is located on the inner peripheral side of the circle C1. Nevertheless, no recesses 30 are formed in the upstream surface (surface on the near side in FIG. 7) of the connection portions 25.

As described above, the air-sending device 200 according to the present embodiment includes the propeller fan 100, the fan motor 110 that drives the propeller fan 100, and the support element 120, which includes the motor fixing portion 121 and the support portion 122. The fan motor 110 is fixed to the motor fixing portion 121. The support portion 122 supports the motor fixing portion 121. When viewed in a direction parallel to the rotation axis R, the plural recesses 30 are formed only on the inner peripheral side of the minimum circle C1 that surrounds the motor fixing portion 121 about the rotation axis R as the center. In this structure, the plural recesses 30 are formed only in an area that undergoes an aerodynamic work to a lesser extent. This structure can make the plural recesses 30 deeper, so that the blades 20 can be further reduced in weight while retaining the efficiency of the propeller fan 100. Thus, according to the present embodiment, the air-sending device 200 enables reduction of power consumption while retaining its performance.

Embodiment 4

Figure 8:
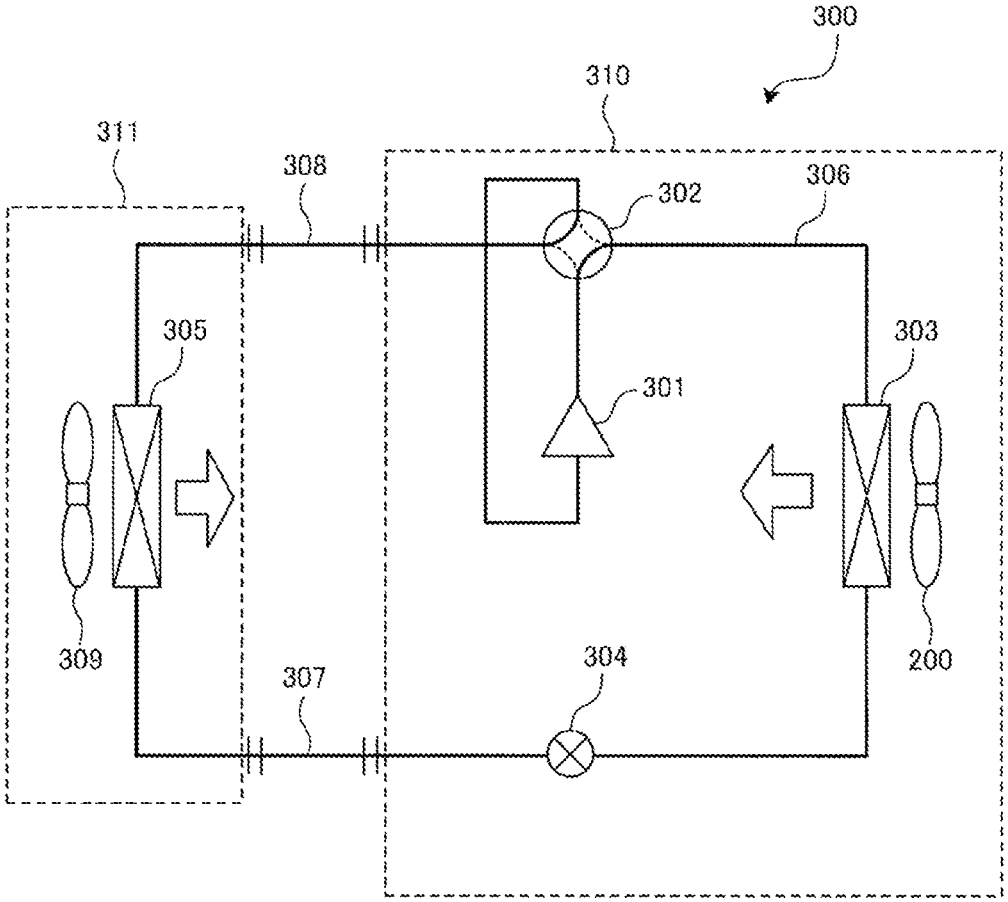
FIG. 8 is a refrigerant circuit diagram of a structure of a refrigeration cycle device 300 according to Embodiment 4 of the present invention.

A refrigeration cycle device according to Embodiment 4 of the present invention will be described. FIG. 8 is a refrigerant circuit diagram of a structure of the refrigeration cycle device 300 according to the present embodiment. The present embodiment illustrates an air-conditioning apparatus as an example of the refrigeration cycle device 300. The refrigeration cycle device according to the present embodiment is also applicable to a device such as a refrigerating machine or a water heater.

As illustrated in FIG. 8, the refrigeration cycle device 300 includes a refrigerant circuit 306 in which a compressor 301, a four-way valve 302, a heat source-side heat exchanger 303, a decompression device 304, and a load-side heat exchanger 305 are sequentially connected with a refrigerant pipe. The refrigeration cycle device 300 includes an outdoor unit 310 and an indoor unit 311. The outdoor unit 310 accommodates the compressor 301, the four-way valve 302, the heat source-side heat exchanger 303, the decompression device 304, and an air-sending device 200, which feeds outdoor air to the heat source side heat exchanger 303. The indoor unit 311 accommodates the load-side heat exchanger 305, and an air-sending device 309, which feeds air to the load-side heat exchanger 305. The outdoor unit 310 and the indoor unit 311 are connected to each other with two extension pipes 307 and 308, which form part of the refrigerant pipe.

The compressor 301 is a piece of fluid machinery that compresses and discharges sucked refrigerant. The four-way valve 302 is a device that switches refrigerant flow paths one from another between a cooling operation and a heating operation under control of a controller, not illustrated. The heat source side heat exchanger 303 is a heat exchanger that exchanges heat between refrigerant flowing inside and outdoor air fed from the air-sending device 200. The heat source side heat exchanger 303 functions as a condenser during a cooling operation, and functions as an evaporator during a heating operation. The decompression device 304 is a device that decompresses the refrigerant. An electronic expansion valve where the opening degree is adjusted by being controlled by a controller may be used as the decompression device 304. The load-side heat exchanger 305 is a heat exchanger that exchanges heat between refrigerant flowing inside and air fed from the air-sending device 309. The load-side heat exchanger 305 functions as an evaporator during the cooling operation and functions as a condenser during the heating operation.

Figure 9:
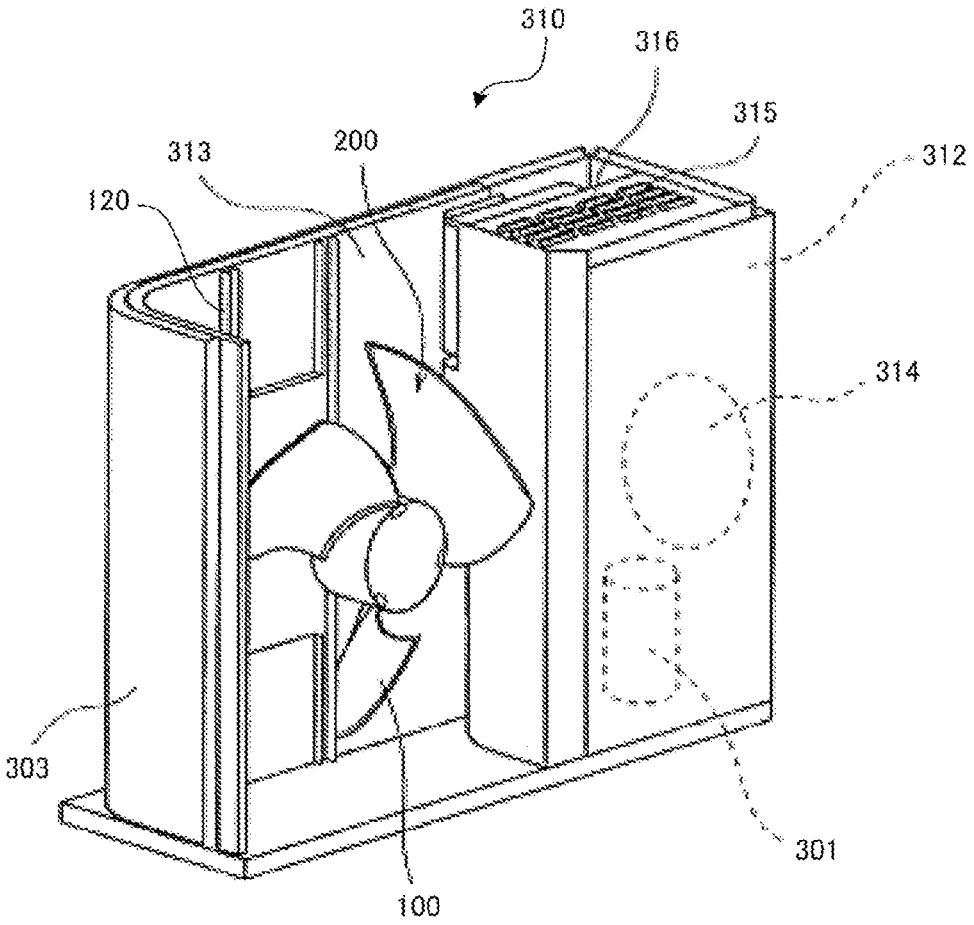
FIG. 9 is a perspective view of an internal structure of an outdoor unit 310 of the refrigeration cycle device 300 according to Embodiment 4 of the present invention.

FIG. 9 is a perspective view of the internal structure of the outdoor unit 310 of the refrigeration cycle device 300 according to the present embodiment. As illustrated in FIG. 9, the inside of the housing of the outdoor unit 310 is divided into a machine room 312 and a fan chamber 313. The machine room 312 accommodates constituent elements such as the compressor 301 and a refrigerant pipe 314. A panel box 315 is disposed in an upper portion of the machine room 312. The panel box 315 accommodates a control panel 316 forming the controller. The fan chamber 313 accommodates the air-sending device 200, which includes the propeller fan 100, and the heat source side heat exchanger 303, to which outdoor air is fed by the air-sending device 200. The propeller fan 100 and the fan motor 110 (not illustrated in FIG. 9) that drives the propeller fan 100 are supported by the support element 120. The air-sending device 200 according to Embodiment 3 or another air-sending device including the propeller fan 100 according to Embodiment 1 or 2 may be used as an example of the fan 200.

As described above, the refrigeration cycle device 300 according to the present embodiment includes the propeller fan 100 according to Embodiment 1 or 2 or the air-sending device 200 according to Embodiment 3. The present embodiment can achieve the same advantageous effects as those in any one of Embodiments 1 to 3.

The above-described embodiments may be combined one with another as appropriate.

Reference Signs List

10 boss 11 shaft portion 20 blade 20*a* pressure surface 20*b* negative pressure surface 21 leading edge 22 trailing edge 23 outer peripheral edge 24 inner peripheral edge 25 connection portion 26 rib 26*a* end portion 30, 30*a*, 30*b*, 30*c*, 30*d*, 30*e* recess 31 opening end 31*a* first opening end 31*b* second opening end 32 inner wall surface 33 bottom surface 100 propeller fan 110 fan motor 120 support element 121 motor fixing portion 122 support portion 122*a* upper support portion 122*b* lower support portion 123 fastening element 200 air-sending device 300 refrigeration cycle device 301 compressor 302 four-way valve 303 heat source-side heat exchanger 304 decompression device 305 load-side heat exchanger 306 refrigerant circuit 307, 308 extension pipe 309 air-sending device 310 outdoor unit 311 indoor unit 312 machine room 313 fan chamber 314 refrigerant pipe 315 panel box 316 control panel C1 circle R rotation axis

The invention claimed is:

1. An air-sending device, comprising:

a propeller fan comprising a shaft portion disposed on a rotation axis of the propeller fan, and a blade disposed on an outer peripheral side of the shaft portion, and including a leading edge and a trailing edge; and a fan motor that drives the propeller fan, wherein the blade includes a rib extending from the shaft portion in a direction away from the rotation axis of the propeller fan, wherein the blade includes a negative pressure surface in which a plurality of recesses are formed, and the plurality of recesses include a first recess and a second recess disposed nearer a trailing edge side of the blade than the first recess in a circumferential direction about the rotation axis as a center, wherein the first recess has a depth larger than a depth of the second recess, wherein, when viewed in a direction parallel to the rotation axis, at least one of the first recess and second recess of the plurality of recesses is positioned further from the axis of rotation of the propeller fan than a radially outward end portion of the rib.

2. The air-sending device of claim 1, further comprising:

a support element that includes a motor fixing portion to which the fan motor is fixed, and a support portion that supports the motor fixing portion, the motor fixing portion of the support element having a frame shape extending in a vertical direction, the support portion of the support element including two upper support portions, extending upward from left and right sides of the motor fixing portion in parallel, and two lower support portions, extending downward from the left and right sides of the motor fixing portion in parallel.

3. The air-sending device of claim 2, wherein when viewed in the direction parallel to the rotation axis, the rib remains within a peripheral edge of the motor fixing portion as the propeller fan rotates.

4. The air-sending device of claim 2, wherein when viewed in the direction parallel to the rotation axis, the at least one of the first recess and second recess of the plurality of recesses that is positioned further from the axis of rotation of the propeller fan than the radially outward end portion of the rib is positioned outside of a peripheral edge of the motor fixing portion.

5. The air-sending device of claim 2, wherein, when viewed in the direction parallel to the rotation axis, the plurality of recesses are formed only in an inner peripheral side of a minimum circle that intersect a peripheral edge of the motor fixing portion, a center of the minimum circle being on the rotation axis of the propeller fan.

* * * * *